US007269552B1

(12) United States Patent
Prange et al.

(10) Patent No.: US 7,269,552 B1
(45) Date of Patent: Sep. 11, 2007

(54) QUANTIZING SPEECH SIGNAL CODEWORDS TO REDUCE MEMORY REQUIREMENTS

(75) Inventors: Torsten Prange, Halle (DE); Andreas Engelsberg, Hildesheim (DE); Christian Mittendorf, Hildesheim (DE); Torsten Mlasko, Harsum (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/807,015

(22) PCT Filed: Aug. 21, 1999

(86) PCT No.: PCT/DE99/02633

§ 371 (c)(1),
(2), (4) Date: Nov. 6, 2001

(87) PCT Pub. No.: WO00/21076

PCT Pub. Date: Apr. 13, 2000

(30) Foreign Application Priority Data

Oct. 6, 1998 (DE) ..... 198 45 888

(51) Int. Cl.
*G10L 19/04* (2006.01)

(52) U.S. Cl. ..... 704/219; 704/223; 704/224

(58) Field of Classification Search ..... 704/220–223, 704/230

See application file for complete search history.

(56) References Cited

U.S. PATENT DOCUMENTS 5,199,076 A * 3/1993 Taniguchi et al. ..... 704/207
5,208,862 A * 5/1993 Ozawa ..... 704/216
5,257,215 A * 10/1993 Poon ..... 708/204
5,261,027 A * 11/1993 Taniguchi et al. ..... 704/200
5,307,441 A * 4/1994 Tzeng ..... 704/222
5,313,554 A * 5/1994 Ketchum ..... 704/219
5,487,128 A * 1/1996 Ozawa ..... 704/222
5,570,454 A * 10/1996 Liu ..... 704/223
5,581,652 A * 12/1996 Abe et al. ..... 704/222
5,646,618 A * 7/1997 Walsh ..... 341/67
5,666,370 A * 9/1997 Ganesan et al. ..... 714/752
5,719,992 A * 2/1998 Shoham ..... 704/219
5,734,789 A * 3/1998 Swaminathan et al. ..... 704/206

(Continued)

FOREIGN PATENT DOCUMENTS

EP 0 545 386 6/1993
WO WO96 17465 6/1996

OTHER PUBLICATIONS

Real-time implementations and applications of the US Federal Standard CELP voice coding algorithm□□Macres, J.V.; vol. 1 Tactical Communications: 'Technology in Transition'., Proceedings of the □□Apr. 28-30, 1992, pp. 41-45.*

(Continued)

*Primary Examiner*—Michael N Opsasnick
(74) *Attorney, Agent, or Firm*—Kenyon & Kenyon LLP

(57) ABSTRACT

For the coding or decoding of speech signal sampled values, the values contained in the code books/code tables for the generation of the speech signal parameters are stored in quantized form.

The processing can be carried out using processors with whole-number processing, without deterioration of the speech quality.

13 Claims, 2 Drawing Sheets

U.S. PATENT DOCUMENTS

| | | | | |
|---|---|---|---|---|
| 5,797,121 | A * | 8/1998 | Fette et al. | 704/230 |
| 5,806,034 | A * | 9/1998 | Naylor et al. | 704/256 |
| 5,889,891 | A * | 3/1999 | Gersho et al. | 382/253 |
| 5,983,174 | A * | 11/1999 | Wong et al. | 704/228 |
| 6,233,550 | B1 * | 5/2001 | Gersho et al. | 704/208 |

OTHER PUBLICATIONS

D.E. Knuth, *Seminumerical Algorithms*, Reading, Addison Wesley, US XP002129812, 1994, pp. 204-205.

D.E. Knuth, *Fundamental Algorithms*, Reading, Addison Wesley, US XP002129812, 1988, pp. 120-135.

* cited by examiner

QUANTIZING SPEECH SIGNAL CODEWORDS TO REDUCE MEMORY REQUIREMENTS

FIELD OF THE INVENTION

The present invention relates to a method for coding or decoding speech signal sampled values.

BACKGROUND INFORMATION

In the standard for coding audiovisual objects according to MPEG-4, in ISO/IEC 14496-3 FCD, Subpart 2, parametric coders are specified, in particular the HVXC (Harmonic Vector Excitation Coding) coder, for coding speech at extremely low bitrates. In order to generate the LPC coefficients, the spectral envelopes of the speech signal, and the unvoiced segments, this standard contains a plurality of tables that are present in floating-point format.

In Subpart 3 of this standard, the CELP (Code Excited Linear Prediction) coder for coding speech at medium to low bitrates is described. For generating the LPC coefficients and the gain values, this standard contains a plurality of tables that are present in floating-point format.

For coding such speech signals, the method of "analysis through synthesis" is often used (ANT Nachrichtentechnische Berichte, Heft 5, November 1988, pages 93 to 105). In the mentioned speech coding methods, values are stored in code books, i.e., in the tables, the values being used for the generation of the signal parameters and thus for the coefficients of the speech synthesis filter. The values stored in the code books are read out via an index control unit.

SUMMARY OF THE INVENTION

Through the quantization of the values in the code books, the existing data are limited in their precision (quantization) so that the code book entries can be represented with a finite word length. In this way, their transfer to digital signal processors with whole-number arithmetic can take place without infringing the quality demands prescribed by standards, in particular according to ISO/IEC 14496-3. In contrast to the present invention, in the mentioned working versions of the standards the values for the code books are present in unquantized form, in floating-point format, and can be processed directly only using very expensive and memory-intensive methods. Despite the limitation of precision of the table values, in the present invention an equal subjective quality is to be achieved after the speech decoding. Using the measures of the present invention, a simple transfer—conforming to standards—of the code to various computing platforms is possible without influencing the subjective quality of the coder. Since reduced word lengths are used, a considerable savings of memory capacity, in particular in the form of ROMs, is possible. The present invention can be used with various speech signal coding methods, for example for HVXC coders/decoders or CELP coders/decoders.

DETAILED DESCRIPTION

Before discussing the actual quantization, a speech decoder is first presented in which the inventive quantization is used.

Figure 1:
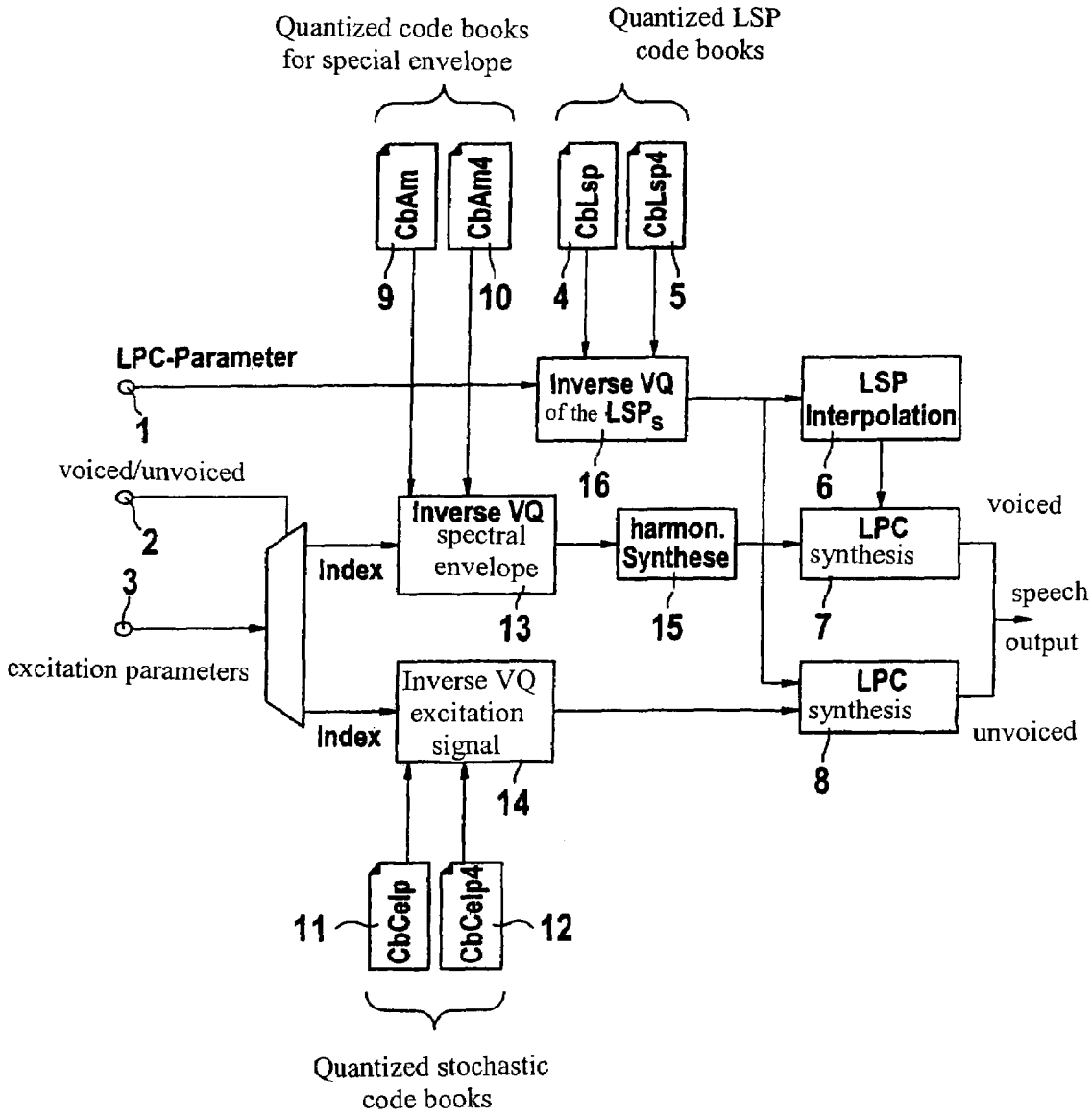
FIG. 1 shows a simplified block switching diagram of an HVXC speech decoder.

In the HVXC speech decoder according to FIG. 1, the transmitted speech parameters, namely the LPC parameters, the voiced/unvoiced decision of the encoder, and the excitation parameters, which are contained in a transmission frame of 20 ms duration, are read out from the bitstream and are supplied as input signals to inputs 1, 2, and 3. The LPC parameters contain indices from which inverse LSP vector quantizer 16 regenerates the LSP (Line Spectral Pairs) parameters. For this purpose, LSP code books 4 (CbLsp) and 5 (CbLsp4) are indexed with the LPC parameters, and the LSP parameters are read out. Dependent on the voiced/unvoiced decision of this frame, if necessary interpolation—module 6—takes place between the LSP parameters of the past and current frame, achieving an updating of these values in a raster of 2.5 ms. Subsequently, conversion takes place into LPC parameters, which enter as coefficients into the LPC synthesis filter—modules 7 and 8.

Parallel to this calculation, and as a function of the voiced/unvoiced decision, the vectors for the spectral envelope (voiced frame), AM code books 9 (CbAm) and 10 (CbAm4), or the vectors for the stochastic excitation signal (unvoiced frame, CELP code books 11 (CbCelp) and 12 (CbCelp4)) are read. The regeneration of the spectral envelopes and of the excitation signal takes place using the inverse vector quantizers 13 and 14. After the harmonic synthesis (voiced)—module 15—the filtering of the speech data takes place in the LPC synthesis filter. The output data from the voiced—module 7—and from the unvoiced—module 8—synthesis filter are subsequently added, yielding the reconstructed speech signal for a frame of 20 ms.

Because, as explained above, values for the code books in floating-point form are not suitable for fixed-point DSPs, because the required word lengths would be too large (memory requirement, internal word lengths and arithmetic, ROM), the conversion of the table values for the code books that were previously obtained by analysis from the speech signal sampled values takes place in a quantized form, with resulting equivalent speech quality. The word lengths required for this for the individual table values are determined in various hearing tests.

The quantization takes place to a word length that is determined in various tests. In the following representation, this word length is designated in general as wordlength. This size is expressed in bits. A signed whole number having wordlength bits includes a value range from $-2^{wordlength-1}$ to $2^{wordlength-1}-1$. The quantization of the code books in this context takes place in the manner shown below. The beginning point is represented by the code books defined in the "Study on ISO/IEC 14496-3 FCD, Subpart 3." For this document, the code book cb is defined as follows: $cb=\{a0, a1, , an, , am\}$ with $0 \leqq n \leqq m$ and $an \epsilon R$. For the quantization of the individual elements, the following steps are required:

1.) Determination of the Value Range of the Code Books

In order to obtain a well-matched quantization, the elements of each code book are scaled in such a manner that the available value range is exploited as completely as possible. For this purpose, the value range of the elements is located between $$\frac{-2^{wordlength-1}}{2^{wordlength-1}} = -1 \text{ and } \frac{2^{wordlength-1}-1}{2^{wordlength-1}} = 1-2^{-(wordlength-1)}$$

In order to achieve this, the maximum of the positive and of the negative elements (max_pos or max_neg) of each code book is determined. These result from $$\text{max_pos}=\max(\{a_n \epsilon cb | a_n \geqq 0\}) \text{ or max_neg}=\min(\{a_n \epsilon cb | a_n \geqq 0\}), \text{ with } 0 \leqq n \leqq m$$

As a function of the magnitude of max_pos or max_neg, the following steps result:

$$\text{max_pos} > (1-2^{-(wordlength-1)}) \text{ or max_neg} \leqq -1$$

max_pos and max_neg are multiplied by 12. If the result still satisfies the condition set under (a), then the process is repeated until the condition no longer holds. The number of multiplications by ½ is counted and is stored in the variables scale.

$$\text{max_pos} \leqq (1-2^{-(wordlength-1)}) \text{ or max_neg} \geqq -1$$

max_pos and max_neg are multiplied by 2. If the result still satisfies the condition set under (b), then the process is repeated until the condition no longer holds. The number of multiplications by 2 is counted and is stored in the variables scale.

2.) Scaling of the Elements of cb to the Range Between −1 and $(1-2^{-(wordlength-1)})$.

As a function of the decision made under 1.), the scaling of all code book entries to the cited range takes place:

$$b_n = \frac{1}{2^{scale}} a_n \forall\, a_n \in cb$$

with $0 \leqq n \leqq m$ $$b_n = 2^{scale} a_n \forall a_n \epsilon cb \text{ with } 0 \leqq n \leqq m.$$

After this step, the entries of each code book are located in the following range of values:

$$-1 \leqq b_n \leqq (1-2^{(wordlength-1)}), \text{ with } 0 \leqq n \leqq m.$$

3.) Scaling to Wordlength Bits

For the scaling to the required value range, multiplication by $2^{wordlength-1}$ takes place. In this way, the values of code books $c^n$ are located in the range between $-2^{wordlength-1}$ and $2^{wordlength-1}$.

4.) Rounding

Before the decimal places are truncated, rounding of the determined entries takes place. For this purpose, depending on the sign +0.5 or −0.5 is added. This takes place in the following form:

$$c_n \geqq 0 : d_n = c_n + 0.5$$

$$c_n < 0 : d_n = c_n - 0.5$$

Here care is to be taken not to exceed the maximum permissible value range. This is located in the range as indicated under 2.).

5.) Truncation of the Decimal Places

The final quantization takes place through the truncation of the decimal places. The quantized values are obtained in this way.

Trials have shown that with the setting of the variables wordlength at 16, a speech quality indistinguishable from the original is obtained.

Figure 2:
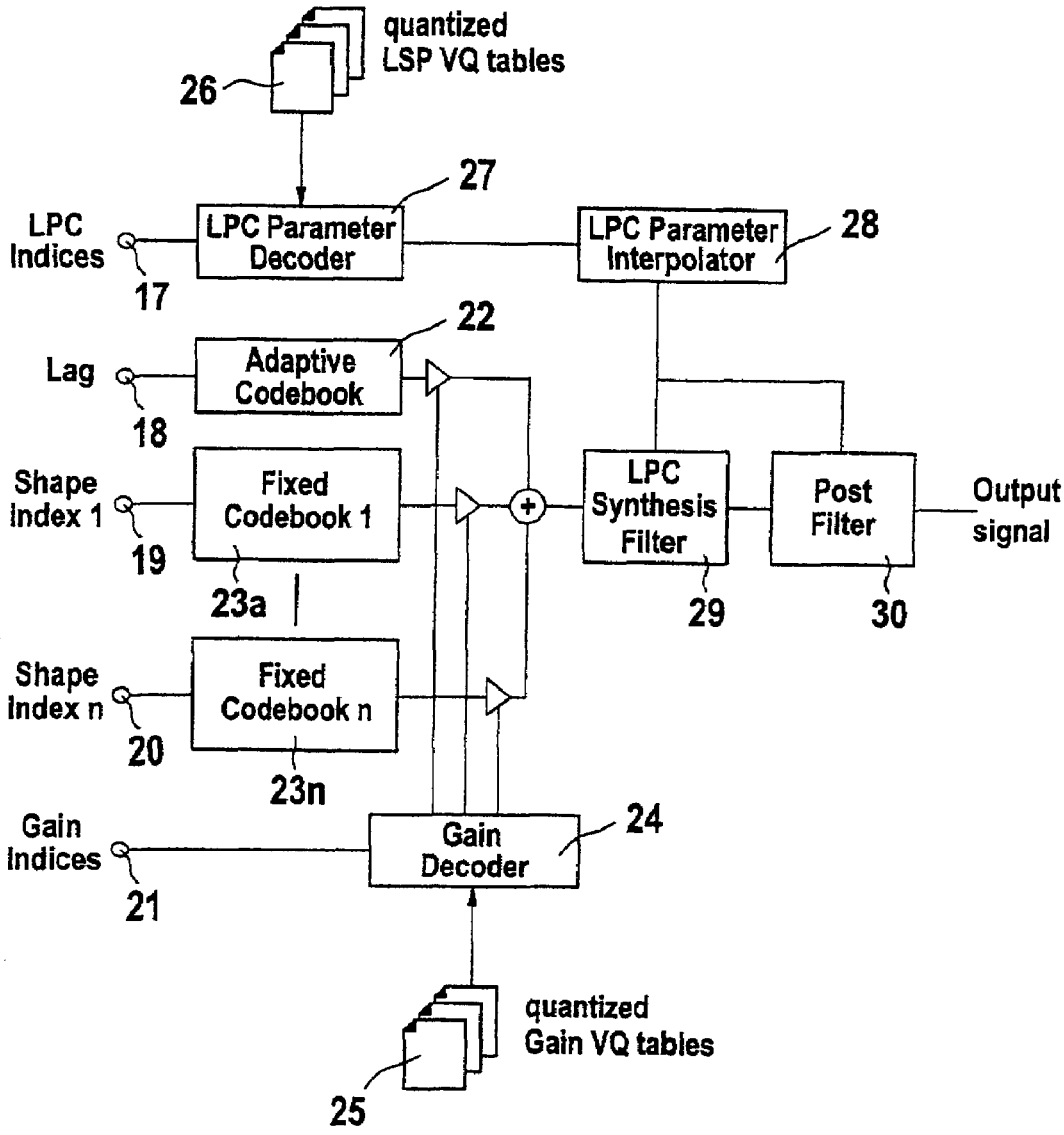
FIG. 2 shows a simplified block switching diagram of a CELP speech decoder.

A further construction of the present invention is explained in connection with FIG. 2.

There, the block switching diagram of a CELP decoder is shown. First, the elements for decoding a frame are read from a transmitted bitstream, as before. These include the LPC indices, the excitation parameters (lag and shape index), and the amplitude indices (gain indices). These parameters (elements) are supplied to decoder inputs 17 to 21. The excitation parameters are made up of the parameters for adaptive code book (lag) 22 for the generation of periodic signal components (voiced) and the parameters for fixed code books (shape index) 23*a* . . . 23*n*.

The entries of fixed code books 23*a* . . . 23*n* and of adaptive code book 22 are each multiplied by a scaling factor (gain) via gain decoder 24. This scaling factor is reconstructed with the aid of the gain indices present at the input 21 and the gain VQ (vector quantization) tables stored in code books 25. The finally valid excitation vector is composed from the sum of the fixed and the adaptive code book vector.

With the use of vector quantizer VQ, the LPC indices represent the vector-quantized LSP (Line Spectral Pairs) parameters. The vectors of the first and second stage of the inverse vector quantization of the LSP parameters are obtained by reading out the LSP-VQ table values, which are stored in code books 26. The finally valid reconstruction of the LPC parameters takes place in LPC parameter decoder 27. Inside each frame, for each subframe interpolation—module 28—takes place between the LSP parameters of the past and of the current frame. The LSP parameters, converted into LPC parameters, enter into LPC synthesis filter 29 as coefficients. The reconstruction of the speech data takes place there through filtering of the excitation signal. In order to improve the speech quality, the reconstructed speech signal can be additionally filtered in a post-filter 30.

The LSP VQ table values, as well as the gain VQ table values for code books 25 and 26, which were previously obtained by analysis from the speech signal sampled values, are normally present in a floating-point representation, which, as explained above, is not suitable for a fixed-point DSP processing. For the same reasons as in the case of the HVXC decoder (FIG. 1), a conversion of the table values into a quantized form takes place. The method steps in this quantization, such as in particular the determination of the value range for the code books, takes place as in the previously explained quantization.

The above exemplary embodiments of the present invention have been explained on the basis of speech decoders. Of course, the present invention can also be used in corresponding coders (encoders) that use code books. There as well, the code book entries can be previously quantized for the preparation of speech signals for transmission. Examples of such encoders whose code book entries can be previously quantized described in European Published Patent Application No. 0545 386, U.S. Pat. No. 5,208,862, U.S. Pat. No. 5,487,128, U.S. Pat. No. 5,199,076, or U.S. Pat. No. 5,261,027.

The invention claimed is:

1. A method for one of coding and decoding speech signal sampled values, comprising the steps of:

quantizing values previously obtained by an analysis from the speech signal sampled values and used for a generation of speech signal parameters before being stored in code books/code tables, the quantizing occurring to a word length that results in no noticeable losses in speech quality;

storing in the code books/code tables the values previously obtained by the analysis from the speech signal sampled values and used for the generation of speech signal parameters;

scaling the values of each code book/code table such that an available range of values is exploited as completely as possible, the step of scaling including the steps of:

determining a maximum of a positive value and a negative value of each code book/code table, if the available range of values is exceeded, performing a multiplication of the values of each code book/code table by a first factor smaller than one, and repeating the multiplication until all elements are located in the available range of values; and causing a number of repeated multiplications to be used as a scaling factor for all code book/code table entries, wherein for a HXVC (Harmonic Vector Excitation Coding) speech coder/speech decoder, LPC coefficients, spectral envelopes of a speech signal, and unvoiced segments of the speech signal are stored in quantized form in corresponding ones of the code books/tables.

2. The method according to claim 1, wherein:

the method is performed in accordance with a method of analysis through synthesis.

3. The method according to claim 1, wherein:

the noticeable losses in speech quality are determined through a hearing test.

4. The method according to claim 1, wherein:

the first factor is 0.5.

5. The method according to claim 1, further comprising the step of:

determining word lengths of the values stored in the code books/code tables through hearing tests.

6. The method according to claim 1, wherein:

the word length is 16 bits.

7. The method according to claim 1, further comprising the step of:

causing a processing of the code book/code table entries to occur in accordance with a digital signal processing in a whole-number format.

8. The method according to claim 1, further comprising the step of:

scaling the code book/code table entries to bits of a required value range.

9. The method according to claim 8, further comprising the step of:

for a finally valid quantization, performing a rounding and a subsequent truncation of decimal places.

10. A method for one of coding and decoding speech signal sampled values, comprising the steps of:

quantizing values previously obtained by an analysis from the speech signal sampled values and used for a generation of speech signal parameters before being stored in code books/code tables, the quantizing occurring to a word length that results in no noticeable losses in speech quality;

storing in the code books/code tables the values previously obtained by the analysis from the speech signal sampled values and used for the generation of speech signal parameters;

scaling the values of each code book/code table such that an available range of values is exploited as completely as possible, the step of scaling including the steps of:

determining a maximum of a positive value and a negative value of each code book/code table, if the available range of values is exceeded, performing a multiplication of the values of each code book/code table by a first factor smaller than one, and repeating the multiplication until all elements are located in the available range of values; and causing a number of repeated multiplications to be used as a scaling factor for all code book/code table entries, wherein:

for a CELP (Code Excited Linear Prediction) speech coder/decoder, values for LSP (Line Spectral Pairs) VQ vector quantization code book/table entries, as well as those of gain VQ table entries, are stored in quantized form.

11. An apparatus corresponding to one of a coder and a decoder for processing speech signal sampled values in accordance with a method of analysis through synthesis, comprising:

an arrangement for storing in quantized form values contained in code books/code tables for a generation of speech signal parameters;

an arrangement for selecting a word length such that no noticeable losses in speech quality occur;

an arrangement for quantizing the values contained in the code books/code tables to the word length that results in no noticeable losses in speech quality;

an arrangement for scaling the values of each code book/code table such that an available range of values can be exploited as completely as possible;

an arrangement for determining a maximum of positive values and negative values of each code book/code table, and for multiplying the values of each code book/code table by a first factor less than one if the available range of values is exceeded; and an arrangement for, if a multiplication of the values of the code books/code tables lies outside the available range of values, performing a repeated multiplication until all elements are located in the available range of values, and for providing a number of repeated multiplications as a scaling factor.

12. The apparatus according to claim 11, wherein:

the noticeable losses in speech quality are determined through a hearing test.

13. The apparatus according to claim 11, wherein:

the first factor is 0.5.

* * * * *